United States Patent [19]

Jenkner

[11] 4,362,108

[45] Dec. 7, 1982

[54] CONVEYOR SYSTEM

[76] Inventor: Erwin Jenkner, Lindenstrasse 13, D-7261 Gechingen, Fed. Rep. of Germany

[21] Appl. No.: 125,358

[22] Filed: Feb. 28, 1980

Related U.S. Application Data

[63] Continuation-in-part of Ser. No. 109,920, Jan. 7, 1980, abandoned.

[51] Int. Cl.[3] ..... B61B 3/00; E01B 5/02

[52] U.S. Cl. ..... 104/94; 104/243

[58] Field of Search ..... 104/106, 93, 110, 111, 104/118, 79, 80, 94, 107, 137, 243

[56] References Cited

U.S. PATENT DOCUMENTS

| | | | |
|---|---|---|---|
| 2,972,965 | 2/1961 | Sjostrom | 104/110 |
| 3,854,406 | 12/1974 | Monne | 104/94 |
| 4,125,908 | 11/1978 | Vail et al. | 104/94 |

*Primary Examiner*—Richard A. Bertsch

*Attorney, Agent, or Firm*—Kontler, Grimes & Battersby

[57] ABSTRACT

A conveyor system is composed of a trolley and an elongated inverted U-shaped or C-shaped track which is formed without any machining involving removal of material by simple deformation of a sheet-metal blank. The track has a horizontal or vertical web, two vertical or horizontal legs extending from the marginal portions of the web, and two horizontal or vertical ledges which constitute the inwardly bent end portions of the legs. One of the ledges has a V-shaped cross-sectional outline and the other ledge has an inturned carrier for a toothed rack in mesh with a pinion driven by a motor on the trolley. The trolley has a first pair of rollers whose conical peripheral surfaces engage the opposite sides of the V-shaped ledge, and a second pair of rollers whose cylindrical peripheral surfaces engage the opposite sides of the other ledge. One roller of each pair is adjustable to ensure that both rollers of each pair engage the corresponding ledge with negligible clearance. The V-shaped portion of the one ledge can receive a steel rod which reinforces the track and is engaged by one roller of the respective pair of rollers.

16 Claims, 2 Drawing Figures

CONVEYOR SYSTEM

CROSS-REFERENCE TO RELATED APPLICATION

This is a continuation-in-part of my copending application Ser. No. 109,920 filed Jan. 7, 1980 for "Conveyor System" now abandoned.

BACKGROUND OF THE INVENTION

The present invention relates to conveyor systems in general, and more particularly to improvements in conveyor systems of the type wherein a track serves to guide a trolley, dolly or another vehicle along a predetermined path.

It is well known to guide trolleys or like vehicles along a predetermined path which is defined by a track having elongated polygonal, round or otherwise configurated guide elements for the wheels or other portions of the vehicles. It is not unusual to assemble the track of several heavy, bulky and highly expensive components such as round, polygonal or otherwise profiled metallic stock which must be subjected to lengthy and complex machining in order to ensure adequate guidance of the vehicle during movement along the desired path. The cost of such conventional tracks is especially high if the track is relatively long, e.g., in excess of 1000 millimeters, particularly if the vehicle is to be confined to movement along its path with zero play or with negligible clearance. A high percentage of the cost is attributable to the need for one or more material removing treatments to which several or all constituents of the track must be subjected in order to provide the desired accurate finish.

OBJECTS AND SUMMARY OF THE INVENTION

An object of the invention is to provide a conveyor system of the type wherein a vehicle is confined to reciprocatory movement along a path defined by an elongated track which can be manufactured at a fraction of the cost of heretofore known tracks for similar vehicles.

Another object of the invention is to provide a novel and improved track for use in a conveyor system of the above outlined character.

A further object of the invention is to provide a novel and improved vehicle for use in a conveyor system of the above outlined character.

An additional object of the invention is to provide a novel and improved method of making the aforediscussed track.

An ancillary object of the invention is to provide a novel and improved method of providing means which defines an elongated path for movement of dollies, trolleys or analogous wheel-mounted vehicles.

The improved conveyor system comprises an elongated straight track which consists of metallic sheet material and includes a substantially V-shaped portion extending lengthwise of the track, and a vehicle including a follower unit (e.g., a pair of rollers or wheels having conical peripheral surfaces) engaging with and having a configuration at least in part complementary to that of the V-shaped portion of the track so as to confine the vehicle to movement lengthwise of the track.

In accordance with a presently preferred embodiment of the invention, the track has a substantially U-shaped or C-shaped cross-sectional outline and includes a pair of spaced-apart legs and a web between the legs. One of the legs comprises a ledge which extends toward the other leg and includes the aforesaid V-shaped portion. The other leg can be provided with a second ledge which is engaged by a second follower unit of the vehicle and can support a portion of the means for moving the vehicle along the track. The web is horizontal or nearly horizontal, or vertical or nearly vertical, and the legs are preferably vertical or nearly vertical, or horizontal or nearly horizontal. The ledge or ledges are preferably parallel or substantially parallel to the web.

The follower unit or units of the vehicle are preferably adjustable so as to ensure that the vehicle is confined to travel along a predetermined path, i.e., with negligible clearance or play for movement in any direction but lengthwise of the V-shaped portion.

In order to stiffen the track so that the latter can stand substantial deforming stresses, e.g., when the vehicle is used to carry heavy loads, the track is preferably reinforced in one or more regions, preferably in the regions between the marginal portions of the aforementioned web and the legs of the track. The reinforcements may include suitably profiled (e.g., L-shaped or otherwise configurated) portions of the track.

Alternatively, the reinforcing means may include an elongated stiffening member in the form of a rod or bar which is secured to the track and preferably extends into the V-shaped portion of the track. For example, the stiffening member may constitute an elongated rod consisting of hardened steel and having a circular cross-sectional outline and a precision-finished smooth (e.g., ground and/or polished) peripheral surface. The corresponding follower unit of the vehicle then comprises at least one roller or wheel which engages the stiffening member. Another roller or wheel of such follower unit engages the opposite side of the V-shaped portion.

The novel features which are considered as characteristic of the invention are set forth in particular in the appended claims. The improved conveyor system itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
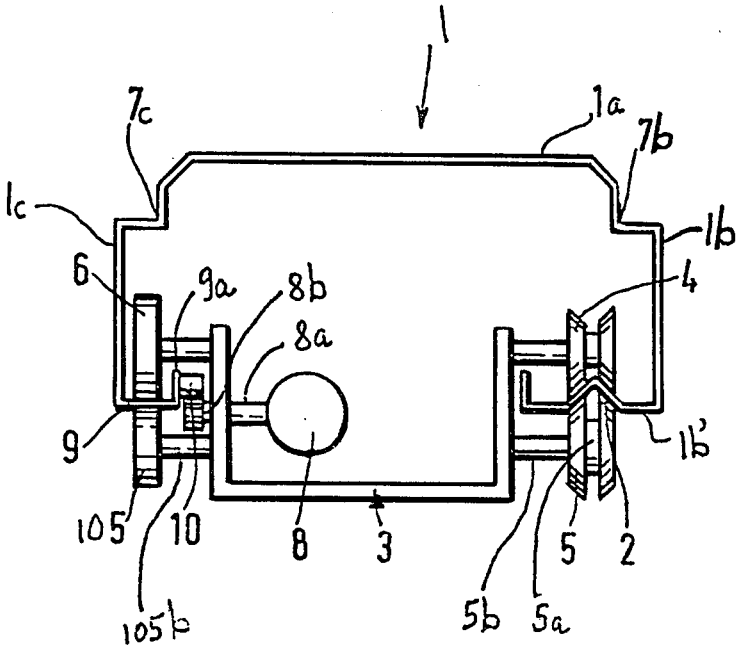
FIG. 1 is a somewhat schematic end elevational view of a track and of a vehicle which together constitute the improved conveyor system.

FIG. 1 shows a conveyor system which includes an elongated straight track 1 and a vehicle 3 which is confined to movement in a predetermined direction, namely, to reciprocatory movement lengthwise of the track 1 (at right angles to the plane of the drawing).

In accordance with a feature of the invention, the entire track 1 is made of a sheet metal blank, e.g., a blank which consists of sheet steel and has a predetermined thickness throughout so that the track need not be subjected to lengthy, complex and/or expensive secondary treatment or treatments. In other words, the steps of making the track 1 merely involve the making of an elongated blank which is cut from a larger panel or sheet of metallic sheet stock and is thereupon subjected to deforming treatment in an upsetting, bending, pressing or other suitable machine to convert the blank into the track 1. Thus, the making of the track 1 need not (and normally does not) involve any material removing operation in expensive machine tools or the like. All that is necessary is to bend selected portions of the elongated blank so as to convert the blank into a body having a substantially U-shaped cross-sectional outline and including a substantially horizontal web 1*a* and two substantially vertical legs 1*b*, 1*c* which flank the web 1*a* and are connected to the respective marginal portions of the web by reinforcing or stiffening portions 7*b* and 7*c*. Each such stiffening portion is an integral part of the track 1 and has a substantially L-shaped, partly L-shaped and partly open V-shaped and/or other profile which enhances the resistance of the track 1 to deforming stresses, e.g., when the vehicle 3 constitutes a dolly which serves for the transport of relatively heavy loads arranged thereon as the work piece holder in a machine for wood machining, or as the tools in such a machine, especially the circular saw blade and driving motor of a circular sawing machine. The cost of the track 1 is but a very small fraction of the cost of conventional tracks which are assembled of heavy, bulky and highly expensive tie rods or like components whereby the components must be machined with utmost precision in order to reduce the extent of play between such conventional track and a wheel-mounted vehicle.

The means for eliminating play between the vehicle 3 and the track 1, i.e., for ensuring that the vehicle 3 is confined to mere reciprocatory movement in directions at right angles to the plane of the drawing, comprises a substantially horizontal ledge 1*b*′ which constitutes the lowermost portion of the leg 1*b* and is bent inwardly toward a similar ledge 9 or lowermost portion of the leg 1*c*. The median portion 2 of the ledge 1*b*′ which latter is substantially coplanar with (i.e., located at the level of) the ledge 9 and is parallel or nearly parallel with the web 1*a*, is V-shaped and its upper and lower sides are respectively engaged by the conical peripheral surfaces of two wheels or rollers, namely, a first roller 4 which engages the upper side of the V-shaped portion 2 and a second roller or counterroller 5 which engages the underside of the portion 2. The latter extends in the longitudinal direction of the track 1, i.e., it is parallel with the web 1*a*, legs 1*b*, 1*c* and ledges 1*b*′, 9 (in the sense that each of these parts extends at right angles to the plane of the drawing). Since the conical peripheral surfaces of the roller 4 and counterroller 5 can readily follow the respective sides of the V-shaped portion, the vehicle 3 is confined to lengthwise movement along a path which is normal to the plane of the drawing. The two-piece rim of the counterroller 5 is rotatable on a hub 5*a* which is eccentric relative to a shaft 5*b* secured to the vehicle 3 so that (when necessary) by changing the angular position of the shaft 5*b* and by thereupon fixing the shaft 5*b* in the newly selected angular position, the rim of the counterroller 5 can be caused to bear against the underside of the V-shaped portion 2 to thereby compel the peripheral surfaces of the two-piece rim of the roller 4 to remain in engagement with the upper side of the portion 2. This eliminates the play or reduces the play between the vehicle 3 and the track 1 to a minimum.

The rollers 4, 5 constitute a first follower unit of the vehicle 3, and this follower unit cooperates with the V-shaped portion 2 of the ledge 1*b*′. The vehicle 3 further comprises a second follower unit including an upper roller 6 and a counterroller 105. The cylindrical peripheral surfaces of the rollers 6, 105 engage the respective sides of the ledge 9, i.e., the inwardly bent lower portion of the leg 1*c*. The counterroller 105 is preferably mounted in the same way as the counterroller 5, i.e., an attendant can cause the peripheral surface of the counterroller 105 to bear against the underside of the ledge 9 with a requisite force by restoring to any suitable adjusting means, e.g., to an eccentric which constitutes the hub of the counterroller 105 and can be rotated by changing the angular position of the shaft 105*b* which is secured to the frame of the vehicle 3.

The rollers 4, 6 and/or the counterrollers 5, 105 preferably consist of highly wear-resistant synthetic plastic material. Owing to adjustability of the counterrollers 5, 105 (and/or rollers 4, 6) at right angles to the longitudinal direction of the track 1, the two follower units establish a wobble-free connection which can be called a form-locking connection because the clearance between the V-shaped portion 2 and the rollers 4, 5 of the right-hand follower unit and/or the clearance between the ledge 9 and the rollers 6, 105 of the left-hand follower unit is just sufficient to enable the vehicle 3 to move forwardly or backwards without excessive frictional engagement with the track 1. Since the thickness of the blank of which the track 1 is made is constant, the play between the vehicle 3 and the track 1 does not increase or decrease in response to movement of the vehicle to different positions, i.e., to positions at different distances from the one or the other end of the track.

The means for moving the vehicle 3 along the elongated path which is defined by the track 1 includes a suitable prime mover 8 (e.g., a reversible electric, hydraulic or pneumatic motor) on the frame of the vehicle, an output shaft 8*a* which is driven by the prime mover, a pinion 8*b* on the output shaft 8*a*, and an elongated toothed rack 10 which is secured to an elongated carrier 9*a*. The latter constitutes or is integral with the inner portion of the ledge 9. Thus, the means for moving the vehicle 3 along the track 1 comprises several components or portions one of which (namely, the rack 10) is affixed to the track 1 and extends in parallelism with the longitudinal direction of the V-shaped portion 2 of the ledge 1*b*′. As a rule, the carrier 9*a* is an integral part of the ledge 9 and is bent into a vertical plane, i.e., it extends in parallelism with the legs 1*b*, 1*c* and its plane is normal to the plane of the remaining major portion of the ledge 9. This contributes to rigidity of the track 1, the same as the V-shaped portion 2 of the ledge 1*b*′ and the stiffening portions 7*b*, 7*c*.

Figure 2:
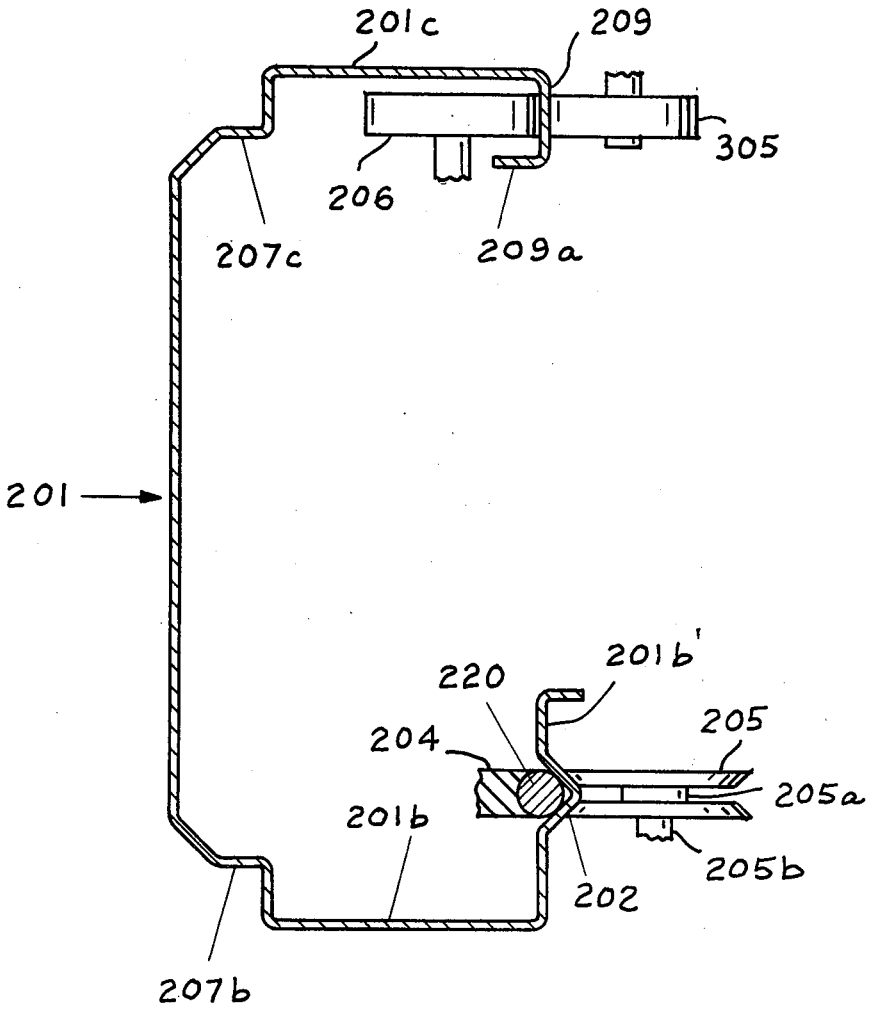
FIG. 2 is an end elevational view of a modified track with a stiffening member which constitutes a steel rod.

FIG. 2 shows a modified track 201 which can be utilized as a substitute for the track 1 in combination with a slightly modified vehicle having a first follower unit including the rollers or wheels 204, 205 and a second follower unit including the rollers or wheels 206, 305. The substantially C-shaped track 201 consists of sheet steel having a constant thickness. This track is made by deforming a suitable blank in a precision press or a like shaping machine. The V-shaped portion 202 is provided in a vertical ledge 201*b*′ which constitutes the end portion of the lower leg 201*b* of the track 201. In accordance with a feature of the embodiment which is shown in FIG. 2, the reinforcing means for the track 201 comprises an elongated stiffening member 220 in the form of an elongated rod which is made of steel and has a circular cross-sectional outline. The material of the rod 220 is preferably hardened and its peripheral surface is preferably finished to a high degree of smoothness. For example, the peripheral surface of the rod 220 may be ground and/or polished. The rod 220 extends into the V-shaped portion 202 and may be welded, glued or otherwise bonded to the track 201. It is also possible to resort to threaded connector means or to any other means which is capable of adequately securing the rod 220 to the ledge 210*b'* so that the latter exhibits the necessary rigidity and ensures proper guidance of the vehicle including the rollers 204, 205 and 206, 305.

If desired, the track 201 can be provided with additional reinforcing means 207*b*, 207*c* which are similar or analogous to the reinforcing means 7*b*, 7*c* of the track 1 shown in FIG. 1.

The roller 204 engages with and rolls along the peripheral surface of the stiffening rod 220, and the roller 205 engages with and rolls along the outer side of the V-shaped portion 202. The hub 205*a* of the roller 205 is an eccentric which is secured to a shaft 205*b* of the vehicle. The latter can be turned to thereby change the distance between the peripheral surfaces of the rollers 204, 205, i.e., to change the extent of play with which the vehicle can be advanced along the track 201. The rollers of the two follower units preferably consist of a suitable wear-resistant synthetic plastic material.

The rollers 206, 305 respectively engage the inner and outer sides of the ledge 209 which constitutes the end portion of the other leg 201*c* of the track 201. The ledge 209 has an inwardly bent carrier 209*a* which is connected with a toothed rack, not shown, corresponding to the rack 10 of FIG. 1 and forming part of the means for driving the vehicle along the path which is defined by the track 201. The roller 206 and/or 305 is preferably adjustable toward or away from the other of these rollers so as to change the distance between the peripheral surfaces thereof, i.e., to change the extent of play between the follower unit 206, 305 and the ledge 209. The adjusting means for the roller 206 and/or 305 may comprise an eccentric or any other suitable device which allows for accurate adjustments of the distance between the peripheral surfaces of the two rollers.

The treatment (e.g., hardening and/or grinding and/or polishing) to which the stiffening rod 220 is subjected prior to attachment to the track 201 is preferably such that the treatment does not entail any deformation of the rod.

The track 201 and its stiffening rod 220 can readily insure that the tolerances within which the vehicle is movable at right angles to the plane of FIG. 2 remain in the range of ±0.05 mm. Though the cost of the combined guide means 201, 220 of FIG. 2 is or can be somewhat higher than that of the track 1 of FIG. 1, such cost is still well below the cost of tracks in conventional conveyor systems wherein several component parts of the track require accurate machining, grinding, polishing and/or other secondary treatment.

An additional advantage of the composite guide means 201, 220 is that, if necessary, the rod 220 can be subjected to one or more secondary treatments in relatively simple machinery since such treatment or treatments can be carried out prior to attachment of the rod to the track 201. This is much less expensive than the machining of bulky tracks which are used in conventional conveyor systems. Moreover, it is much less likely that the hardening of the relatively lightweight rod 220 entails a pronounced deformation (e.g., bending, twisting or the like) than if the hardening operation involves the treatment of a bulky component part of a conventional track. In fact, many conventional tracks or their component parts can be hardened only if the hardening step is performed while the part or parts to be hardened are held by complex and expensive devices which prevent excessive deformation of such parts.

Once the treatment of the rod 220 is completed, the latter can be immediately inserted into and properly centered or located by the V-shaped portion 202 of the track 201. This constitutes a further advantage, i.e., there is no need to resort to complex centering or aligning means because the rod 220 automatically assumes an optimum position in the inner side of the V-shaped portion 202.

It is possible to replace the rod 220 with a stiffening member having an oval, semicircular, or polygonal cross-sectional outline. However, the illustrated rod-shaped member 220 is preferred at this time because it can be readily formed by removing a desired length from commercially available rod steel stock. This contributes to a reduction of the cost of the composite guide means. It has been found that, if the material of the stiffening member is steel and the stiffening member is hardened and properly surface-treated, the wear upon the composite guide means is surprisingly low for extended periods of time, even if the vehicle including the follower units 204, 205 and 206, 305 is designed to carry heavy loads and moves back and forth at elevated speeds and/or at frequent intervals. This reduces the need for frequent interruptions of operation of the improved conveyor system.

The improved conveyor system and the improved method of making the track 1 or 201 are susceptible of many modifications without departing from the spirit of the invention. For example, the blank of which the track 1 or 201 is made need not necessarily consist of steel or need not consist of steel alone. Also, the configuration of the track 1 or 201 can depart from the illustrated configuration, depending on the desired reinforcing effect and/or the dimensions of the track. Still further, the means for biasing the counterrollers 5, 105 or 205, 305 against and/or adjusting these counterrollers relative to the respective sides of the portion 2 or 202 and ledge 9 or 209 and/or for biasing the rollers 4, 6 or 204, 206 against the respective sides of the portion 2 or 202 and ledge 9 or 209 can be constructed and assembled in any suitable way as long as they ensure that the vehicle is confined to movement along its path without excessive play. Still further, the nature of instrumentalities which are used to form the track 1 or 201, without any removal of material but solely as a result of suitable deformation, can be selected practically at will and the selection depends on a host of parameters such as the availability of equipment, the dimensions of the finished track (especially its length), the anticipated stresses upon the track, the material of the blank, and/or the required degree of precision (especially for the forming of the V-shaped portion 2 or 202 and its alinement with the ledge 9 or 209).

The conveyor system of the present invention can be utilized in machines of the type disclosed in my copending application Ser. No. 115,880 filed Jan. 28, 1980 for "Apparatus for advancing and positioning workpieces in sawing machines or the like" now abandoned. In the apparatus of said copending application, the vehicle of the conveyor system advances one or more workpieces against an adjustable stop and carries clamping means for one or more workpieces.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In a conveyor system, the combination of a straight, elongated track having a substantially U-shaped or C-shaped cross-sectional outline and consisting at least in part of sheet metal, said track including a substantially V-shaped portion extending lengthwise of said track and a second portion spaced apart from and parallel to said V-shaped portion, and each of said portions having a first side and a second side, said track further including reinforcing means extending in parallelism with said V-shaped portion, and said track also including a pair of spaced-apart legs and a web between said legs, one of said legs comprising a ledge extending toward the other of said legs and including said V-shaped portion; and a vehicle including a first follower unit which engages said V-shaped portion and has a configuration at least partly complementary to the same so as to confine said vehcile to movement lengthwise of said track, said vehicle further including a second follower unit which engages said second portion of said track, and each of said follower units comprising a roller and a counterroller, said rollers engaging the first sides of the respective portions of said track while said counterrollers bear against the second sides thereof to thereby urge said rollers against the corresponding first sides.

2. In a conveyor system, the combination of a straight, elongated track having a substantially U-shaped or C-shaped cross-sectional outline and consisting at least in part of sheet metal, said track including a substantially V-shaped portion extending lengthwise of said track, and said track also including a web and spaced-apart first and second legs flanking said web, one of said legs comprising a ledge extending toward the other of said legs and including said V-shaped portion, and said track further comprising reinforcing means extending in parallelism with said V-shaped portion, said reinforcing means including first and second profiled portions forming part of said track and disposed between said web and the respective legs; and a vehicle including a follower unit which engages said V-shaped portion and has a configuration at least partly complementary to the same so as to confine said vehicle to movement lengthwise of said track.

3. The combination of claim 2, wherein said web and said ledge are substantially horizontal and said legs are substantially vertical.

4. The combination of claim 2, wherein said other leg comprises a second ledge extending toward and being substantially coplanar with the ledge of said one leg.

5. The combination of claim 2, wherein said track further includes an elongated carrier spaced apart from and parallel with said V-shaped portion; and further comprising means for moving said vehicle lengthwise of said track, said moving means including a portion provided on said carrier.

6. The combination of claim 5, wherein said portion of said moving means includes an elongated toothed rack parallel with said carrier.

7. The combination of claim 2, wherein said track further includes a second portion spaced apart from and parallel with said V-shaped portion, said vehicle including a second follower unit engaging said second portion of said track.

8. The combination of claim 2, wherein said web is disposed at a level above said V-shaped portion.

9. In a conveyor system, the combination of a straight, elongated track having a substantially U-shaped or C-shaped cross-sectional outline and consisting at least in part of sheet metal, said track including a substantially V-shaped portion extending lengthwise of said track, and siad track also including a pair of spaced-apart legs and a web between said legs, one of said legs comprising a ledge extending toward the other of said legs and including said V-shaped portion, and said track further comprising reinforcing means extending in parallelism with said V-shaped portion, said reinforcing means including an elongated stiffening member extending into said V-shaped portion; and a vehicle including a follower unit which engages said V-shaped portion and has a configuration at least partly complementary to the same so as to confine said vehicle to movement lengthwise of said track.

10. The combination of claim 9, wherein said stiffening member is fixedly secured to said track.

11. The combination of claim 9, wherein said follower unit includes a portion which engages said stiffening member.

12. The combination of claim 9, wherein said stiffening member has a substantially circular cross-sectional outline.

13. The combination of claim 9, wherein said stiffening member consists of steel.

14. The combination of claim 13, wherein the material of said stiffening member is hardened.

15. The combination of claim 9, wherein said stiffening member has a smooth peripheral surface.

16. The combination of claim 9, wherein said stiffening member has a ground and/or polished peripheral surface.

* * * * *

UNITED STATES PATENT AND TRADEMARK OFFICE

CERTIFICATE OF CORRECTION

PATENT NO. : 4,362,108

DATED : December 7, 1982

INVENTOR(S) : Erwin JENKNER

It is certified that error appears in the above-identified patent and that said Letters Patent are hereby corrected as shown below:

On the title page, insert:

--[30] FOREIGN APPLICATION PRIORITY DATA
May 16, 1979 [CH] Switzerland . . . . . 4538/79--.

Col. 5, line 9, "210b'" should read --201b'--.

Signed and Sealed this

*Third* Day of *September 1985*

[SEAL]

*Attest:*

DONALD J. QUIGG

*Attesting Officer* *Acting Commissioner of Patents and Trademarks - Designate*